US009108648B2

(12) United States Patent
Li

(10) Patent No.: US 9,108,648 B2
(45) Date of Patent: Aug. 18, 2015

(54) SUPPORTING DEVICE FOR A RAIL VEHICLE FLOOR

(75) Inventor: Xiaomeng Li, Krefeld (DE)

(73) Assignee: Siemens Aktiengesellschaft, Munich (DE)

( * ) Notice: Subject to any disclaimer, the term of this patent is extended or adjusted under 35 U.S.C. 154(b) by 71 days.

(21) Appl. No.: 14/000,248

(22) PCT Filed: Jan. 18, 2012

(86) PCT No.: PCT/EP2012/050696
§ 371 (c)(1),
(2), (4) Date: Aug. 19, 2013

(87) PCT Pub. No.: WO2012/110272
PCT Pub. Date: Aug. 23, 2012

(65) Prior Publication Data

US 2013/0319283 A1 Dec. 5, 2013

(30) Foreign Application Priority Data

Feb. 17, 2011 (DE) ..... 10 2011 011 633

(51) Int. Cl.
*B61D 17/00* (2006.01)
*B61F 1/00* (2006.01)
*B61D 17/10* (2006.01)

(52) U.S. Cl.
CPC .. *B61F 1/00* (2013.01); *B61D 17/10* (2013.01)

(58) Field of Classification Search
CPC ..... B61D 17/10; E04F 19/06; E04F 19/066
USPC ..... 105/414, 413
See application file for complete search history.

(56) References Cited

U.S. PATENT DOCUMENTS

| | | | | |
|---|---|---|---|---|
| 4,930,427 | A * | 6/1990 | Ritter et al. | 105/406.1 |
| 2006/0143921 | A1* | 7/2006 | Altenburg et al. | 29/897.2 |
| 2011/0126733 | A1* | 6/2011 | Stiedl | 105/422 |
| 2011/0278396 | A1* | 11/2011 | Lieven et al. | 244/119 |
| 2012/0139295 | A1* | 6/2012 | Huepperling | 296/193.06 |
| 2013/0213259 | A1* | 8/2013 | Taguchi et al. | 105/422 |
| 2013/0220169 | A1* | 8/2013 | Taguchi et al. | 105/397 |

FOREIGN PATENT DOCUMENTS

| | | | | |
|---|---|---|---|---|
| DE | 102007036670 | A1 * | 2/2009 | B61D 17/10 |
| WO | WO 2012110272 | A1 * | 8/2012 | |

* cited by examiner

*Primary Examiner* — Jason C Smith
(74) *Attorney, Agent, or Firm* — Laurence A. Greenberg; Werner H. Stemer; Ralph E. Locher

(57) ABSTRACT

A supporting device for a floor of a rail vehicle includes an elongate floor rail which is composed of a first metallic material and is divided into a plurality of longitudinal portions or sections, so as to form at least one joint. The floor rail is supported on a rail vehicle shell which is composed of a second metallic material. The floor rail is connected in the region of the joint to an intermediate profile which is provided for interconnecting the mutually adjoining longitudinal sections of the floor rail in a flexurally rigid fashion. A sliding fit or seat is formed between the longitudinal portions or sections of the floor rail and the intermediate profile.

4 Claims, 3 Drawing Sheets

SUPPORTING DEVICE FOR A RAIL VEHICLE FLOOR

BACKGROUND OF THE INVENTION

Field of the Invention

The invention relates to a supporting device for a floor of a rail vehicle, having an elongate floor rail which is divided into a plurality of longitudinal portions, so as to form at least one joint, and is composed of a first metallic material, said floor rail being supported on a shell of the rail vehicle, which shell is composed of a second metallic material. A floor rail in a floor region of a rail vehicle is typically produced from aluminum, whereas a shell of the rail vehicle may consist of steel. If in this case the floor rail is connected to the shell, owing to the present combination of materials the problem occurs during temperature fluctuations that the coefficients of expansion between aluminum and steel are different. The difference in expansion which results must be absorbed without the functions of the floor rail being impaired.

BRIEF SUMMARY OF THE INVENTION

Taking this as the starting point, the object on which the invention is based is to make possible, in the case of a supporting device of the type mentioned at the outset, a difference in expansion between the floor rail and the vehicle shell in the region of a joint of the floor rail.

This object is achieved in that the floor rail is connected in the region of the joint to an intermediate profile which is provided for flexurally rigidly connecting the mutually adjoining longitudinal portions of the floor rail, wherein a sliding fit is formed between the longitudinal portions of the floor rail and the intermediate profile.

The sliding fit provided thus makes it possible to absorb the differences in expansion which occur during temperature fluctuations between aluminum as an example of a first material and steel as an example of a second material.

The floor rail here can be elastically supported in its regions remote from the joint, for example on a steel profile fastened to the vehicle floor, specifically with the interposition of an adhesively bonded foam layer which forms the elastic mounting.

The floor rail can have cavities which extend in its longitudinal direction and in which bar-shaped guide elements are arranged. A flexural rigidity of the connection of the mutually adjoining longitudinal portions of the floor rail is effectively achieved in this way.

The bar-shaped guide elements can be fastened to the intermediate profile with the aid of screws, wherein the floor rail has, at its side facing the intermediate profile, slots which extend in the longitudinal direction of the floor rail, and the screws are arranged in these slots. A reliable connection of the bar-shaped guide elements to the intermediate profile is obtained in this way.

A sliding layer, which can also be formed as a plate, is preferably provided between the floor rail and the intermediate profile. This allows a sliding movement between a longitudinal portion of the floor rail and the intermediate profile without undesirably high frictional forces occurring.

For the same purpose, provision can be made for a sliding layer/sliding plate to be provided in the region of a bearing surface between the bar-shaped guide elements and a portion of the floor rail that faces the intermediate profile.

An exemplary embodiment of the invention will be explained in further detail below with reference to the drawings, in which:

DESCRIPTION OF THE INVENTION

Figure 1:
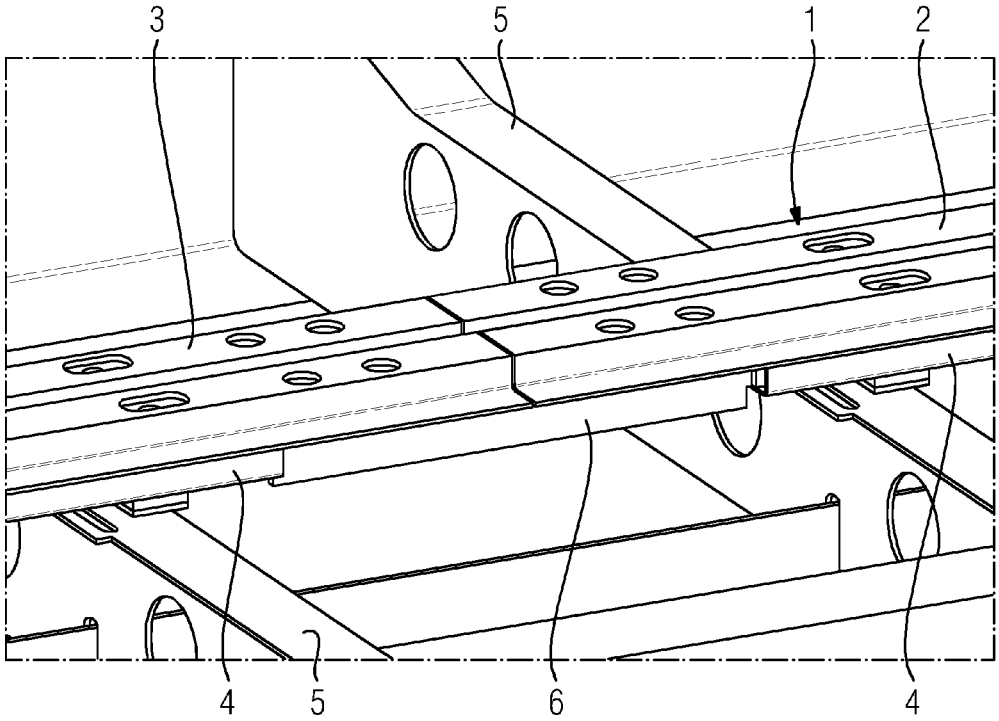
FIG. 1 shows a perspective view of a rail vehicle substructure with a floor rail provided there.

It can be seen in FIG. 1 that a floor rail 1, which is composed of a plurality of mutually adjoining longitudinal portions 2, 3, is supported on the floor of a rail vehicle shell via a steel profile 4 and crossmember 5. In the region of a joint between the mutually adjoining longitudinal portions 2, 3, there is provided, below the floor rail 1, which is divided here, an intermediate profile 6 which serves for the flexurally rigid connection of the longitudinal portions 2, 3.

Here, the crossmembers 5, like the shell of the rail vehicle itself, consist of steel, with the result that differences in expansion between the floor rail 1 and the steel shell can result during temperature fluctuations.

Figure 2:
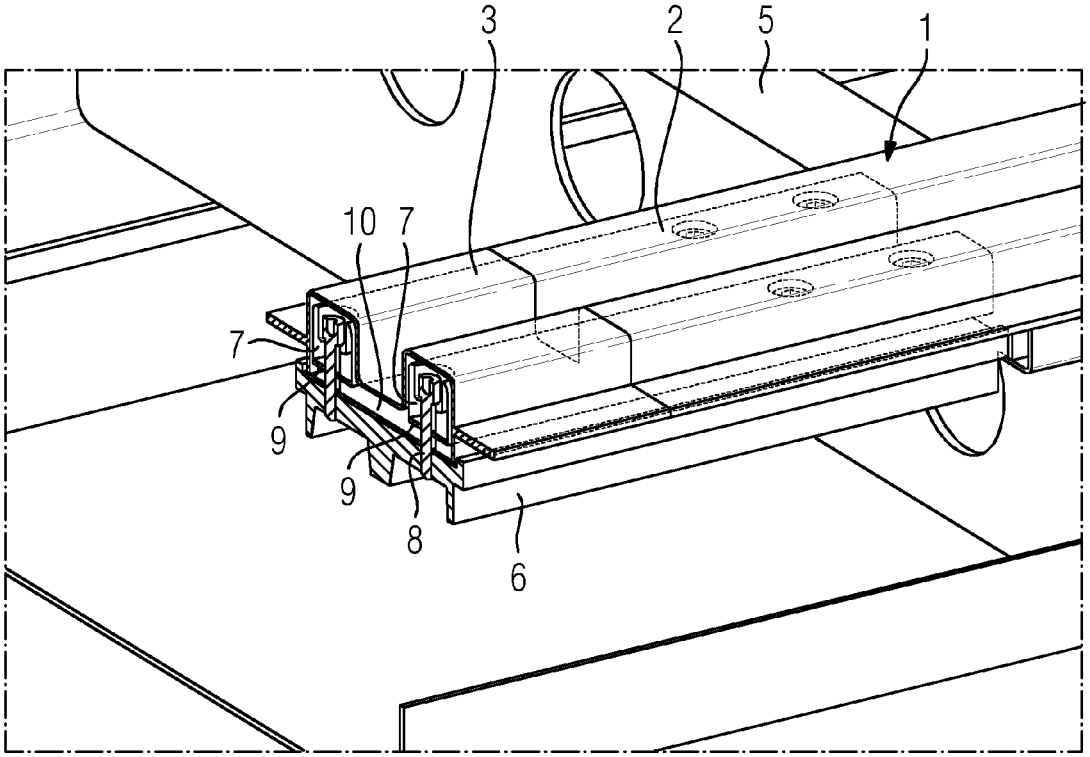
FIG. 2 shows the perspective view of FIG. 1, partly in phantom view.

FIG. 2 now shows in more detail how the longitudinal portions 2, 3 of the floor rail 1 are connected to the intermediate profile 6 in the manner of a sliding fit. For this purpose, the longitudinal portions 2, 3 of the floor rail 1 have two cavities which extend in the longitudinal direction of the floor rail 1 and parallel to one another and in which there are accommodated bar-shaped guide elements 7 which extend approximately over the whole length of the intermediate profile 6 and thus provide a connection between the mutually adjoining longitudinal portions 2, 3 of the floor rail 1. The two bar-shaped guide elements 7 which are present in the present exemplary embodiment are fastened to the intermediate profile with the aid of a total of 8 screws 8, i.e. the screws 8 are screwed into the intermediate profile 6.

At its side facing the intermediate profile 6, the floor rail 1 here has slots at least in the region of the screws 8 in the longitudinal direction of the floor rail 1, which slots allow a relative movement of the longitudinal portions 2, 3 of the floor rail 1 relative to the intermediate profile 6. Here, the intermediate profile 6, which is arranged between the two adjoining steel profiles 4 to support the floor rail 1, will remain substantially immobilized, whereas the two longitudinal portions 2, 3 of the floor rail 1 will move toward one another or away from one another.

The following measures are taken to achieve the lowest possible friction losses during the relative movement of the floor rail 1 with respect to the intermediate profile 6: A sliding bearing plate or layer 9 is provided in the region of bearing surfaces between the underside of the bar-shaped guide elements 7 and the associated inner side of the floor rail 1, whereas a sliding layer/sliding plate 10 is likewise present between the underside of the longitudinal portions 2, 3 of the floor rail 1 and the upper side of the intermediate profile 6. Such a sliding bearing plate can consist for example of nylon, which has excellent properties in terms of impact resistance, low wear and low friction and corrosion resistance.

Figure 3:
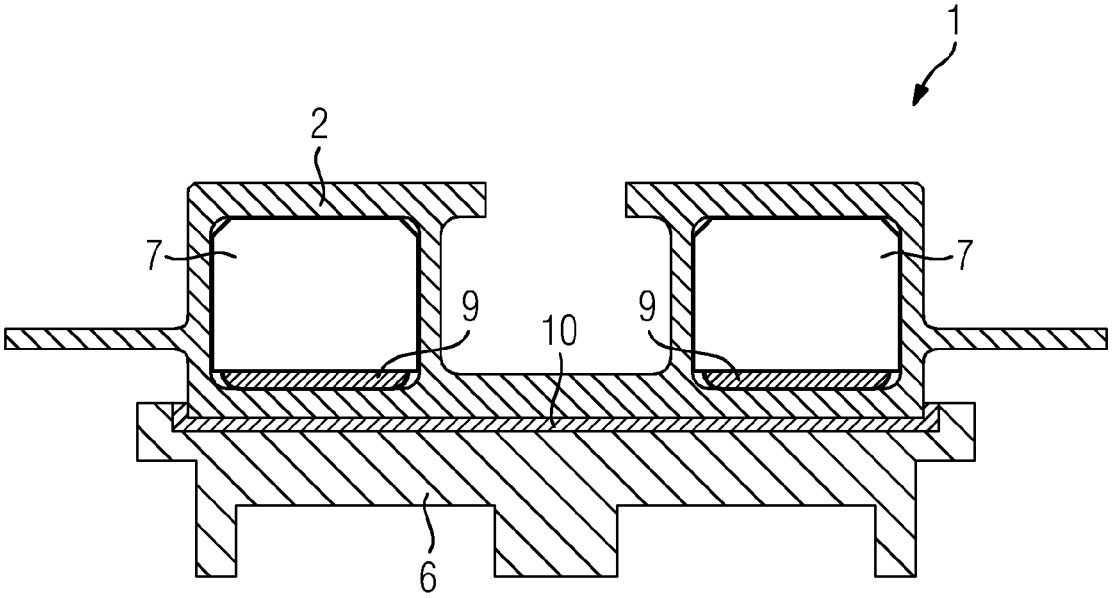
FIG. 3 shows a cross-sectional view of the floor rail of FIG. 1.

The arrangement of the sliding layers additionally emerges from FIG. 3. In this figure, it can also be seen that the intermediate profile 6 laterally engages around the floor rail 1. The sliding layer between intermediate profile 6 and the longitudinal portion 2 of the floor rail 1 extends over a whole width of the floor rail 1 on its side facing the intermediate profile 6.

The invention claimed is:

1. A supporting device for a floor of a rail vehicle, the supporting device comprising:

an elongate floor rail composed of a first metallic material and being supported on a rail vehicle shell composed of a second metallic material, said floor rail being divided into a plurality of mutually adjoining longitudinal portions to form at least one joint, said floor rail having a longitudinal direction, cavities extending in said longitudinal direction and bar-shaped guide elements disposed in said cavities;

an intermediate profile connected to said floor rail in vicinity of said at least one joint, said intermediate profile flexurally rigidly interconnecting said mutually adjoining longitudinal portions;

said floor rail having a side facing said intermediate profile, said side having slots formed therein extending in said longitudinal direction of said floor rail;

screws disposed in said slots, said screws fastening said bar-shaped guide elements to said intermediate profile; and said longitudinal portions and said intermediate profile forming a sliding fit therebetween.

2. The supporting device according to claim 1, which further comprises a sliding layer disposed between said floor rail and said intermediate profile.

3. The supporting device according to claim 1, wherein:

said floor rail has a portion facing said intermediate profile;

said bar-shaped guide elements and said portion of said floor rail define a bearing surface therebetween; and a sliding layer is disposed in vicinity of said bearing surface.

4. The supporting device according to claim 2, wherein said sliding layer is formed of an impact-resistant, low-wear, low-friction and corrosion-insensitive plastic.

* * * * *